US007443360B2

(12) United States Patent
Chan

(10) Patent No.: US 7,443,360 B2
(45) Date of Patent: Oct. 28, 2008

(54) READILY ATTACHABLE CEILING ANTENNA HOUSING

(75) Inventor: Yat To Chan, Tauyuan Hsien (TW)

(73) Assignee: Joymax Electronics Co., Ltd., Chongli Tauyuan Hsien (TW)

( * ) Notice: Subject to any disclaimer, the term of this patent is extended or adjusted under 35 U.S.C. 154(b) by 493 days.

(21) Appl. No.: 11/094,713

(22) Filed: Mar. 30, 2005

(65) Prior Publication Data

US 2006/0252460 A1 Nov. 9, 2006

(51) Int. Cl.
*H01Q 1/42* (2006.01)
*H01Q 1/12* (2006.01)

(52) U.S. Cl. ..... 343/872; 343/878

(58) Field of Classification Search ..... 362/581, 362/319, 554; 343/872, 878; 411/387, 337
See application file for complete search history.

(56) References Cited

U.S. PATENT DOCUMENTS 5,619,217 A * 4/1997 Mailandt et al. ..... 343/872
6,268,882 B1 * 7/2001 Elberbaum ..... 348/151
6,295,036 B1 * 9/2001 Mata et al. ..... 343/878
6,501,965 B1 12/2002 Lucidarme ..... 455/562

* cited by examiner

*Primary Examiner*—Michael C. Wimer
*Assistant Examiner*—Marlon Browne
(74) *Attorney, Agent, or Firm*—Charles E. Baxley

(57) ABSTRACT

A ceiling antenna housing includes a receptacle having a chamber to receive an antenna member and having a number of orifices for receiving fasteners. The fasteners each includes an aperture for engaging with hanger members typically for attaching ceiling panels to a ceiling, and for allowing the ceiling antenna housing to be easily and readily attached to the ceiling without drilling holes by the users themselves. A cover is attached to the receptacle and has a number of cavities for receiving the fasteners. The cover may also include a hooking member or an anchoring member to engage with the hanger members.

5 Claims, 6 Drawing Sheets

READILY ATTACHABLE CEILING ANTENNA HOUSING

BACKGROUND OF THE INVENTION

1. Field of the Invention

The present invention relates to a ceiling antenna housing, and more particularly to a readily attachable ceiling antenna housing for easily and readily attached to the ceiling of the buildings.

2. Description of the Prior Art

Typical ceiling antenna devices may be attached to the ceiling with adhesive materials. However, normally, the ceiling of various buildings are made of concrete materials and/or painted with a painting layer, or covered with a wall paper, to which the typical ceiling antenna devices may not be solidly or firmly attached or secured thereto.

For example, U.S. Pat. No. 6,501,965 to Lucidarme discloses one of the typical ceiling antenna devices for attaching to the ceiling or to the walls with adhesive materials. However, the typical ceiling antenna devices may not be solidly or firmly attached or secured to the ceiling or to the walls with the adhesive materials, and may be easily disengaged from the ceiling or the walls.

For solidly or firmly securing the typical ceiling antenna devices to the ceiling or to the walls of various buildings, a number of holes are required to be drilled into the ceiling or the walls, for engaging the fasteners into the ceiling or the walls, and thus for allowing the typical ceiling antenna devices to be attached or secured onto the ceiling or the walls of various buildings. However, it will be difficult for the users to drill the holes into the ceiling or the walls by themselves.

The present invention has arisen to mitigate and/or obviate the afore-described disadvantages of the conventional ceiling antenna housings.

SUMMARY OF THE INVENTION

The primary objective of the present invention is to provide a ceiling antenna housing for readily attaching to the ceiling of the buildings without drilling holes into the ceiling or the walls by the users themselves.

In accordance with one aspect of the invention, there is provided a ceiling antenna housing comprising a receptacle including a chamber formed therein, and including a number of orifices formed therein, an antenna member received in the chamber of the receptacle, and a number of fasteners engaged through the orifices of the receptacle, and each including an aperture formed therein for engaging with hanger members typically for attaching ceiling panels to a ceiling.

The fasteners each includes an enlarged head provided thereon, for engaging with the receptacle and for anchoring the fasteners to the receptacle. The receptacle includes a number of studs extended therefrom to form and define the orifices thereof.

The receptacle includes a cover attached thereto and having a number of cavities formed therein and aligned with the orifices of the receptacle, for receiving the fasteners therein, and a number of lock nuts threaded to the fasteners. The cover includes a passage formed therein and defined by a casing, and the receptacle includes a notch formed therein, to receive the casing, and to anchor the cover to the receptacle.

In accordance with the other aspect of the invention, there is provided a ceiling antenna housing comprising a hooking member slidably engaged through the slot of the cover and including at least one leg extended therefrom, for engaging with the cover and for limiting the hooking member to move relative to the cover and for preventing the hooking member from being disengaged from the cover, the hooking member including an aperture formed therein for engaging with hanger members typically for attaching ceiling panels to a ceiling.

The cover includes at least one flap extended downwardly therefrom and located beside the slot thereof, the receptacle includes at least one ear extended upwardly therefrom and located beside the flap of the cover, to slidably anchor the hooking member between the flap of the cover and the ear of the receptacle. The hooking member includes a bent flange formed on one end thereof for reinforcing purposes.

In accordance with another aspect of the invention, there is provided a ceiling antenna housing comprising an anchoring member slidably engaged through the groove of the cover and including at least one leg extended therefrom, for engaging with the cover and for limiting the anchoring member to move relative to the cover and for preventing the anchoring member from being disengaged from the cover, the anchoring member including an aperture formed therein for engaging with hanger members typically for attaching ceiling panels to a ceiling.

The cover includes a depression formed therein and communicating with the groove thereof, for receiving the anchoring member. The cover includes a latch extended therefrom for engaging through the aperture of the anchoring members, to anchor the anchoring member to the cover. The receptacle includes at least one protrusion extended therefrom, for engaging with the leg of the anchoring member, and maintaining the anchoring member to the cover.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
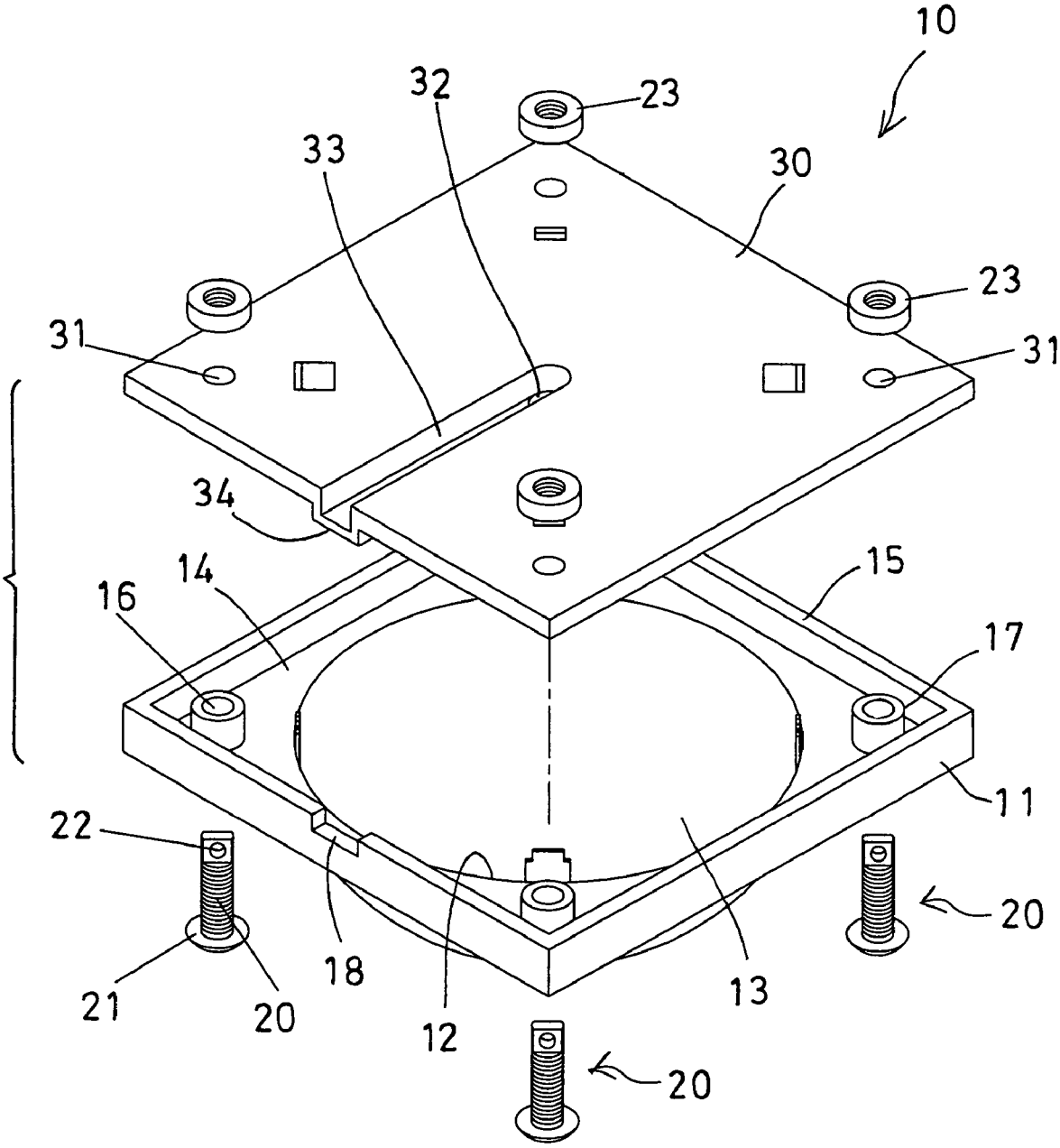
FIG. 1 is a partial exploded view of a ceiling antenna housing in accordance with the present invention.
Figure 2:
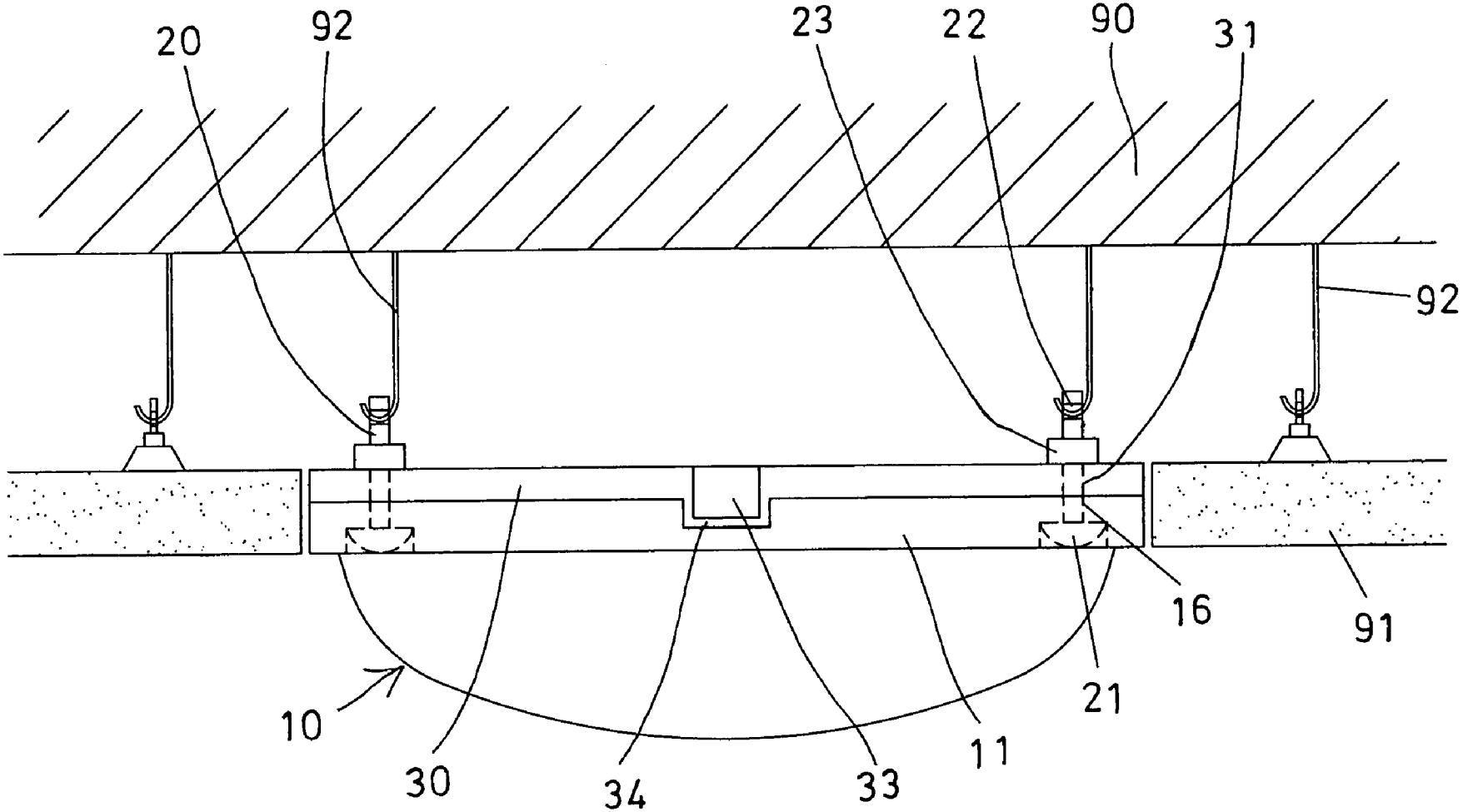
FIG. 2 is a plan schematic view illustrating the application of the ceiling antenna housing.
Figure 3:
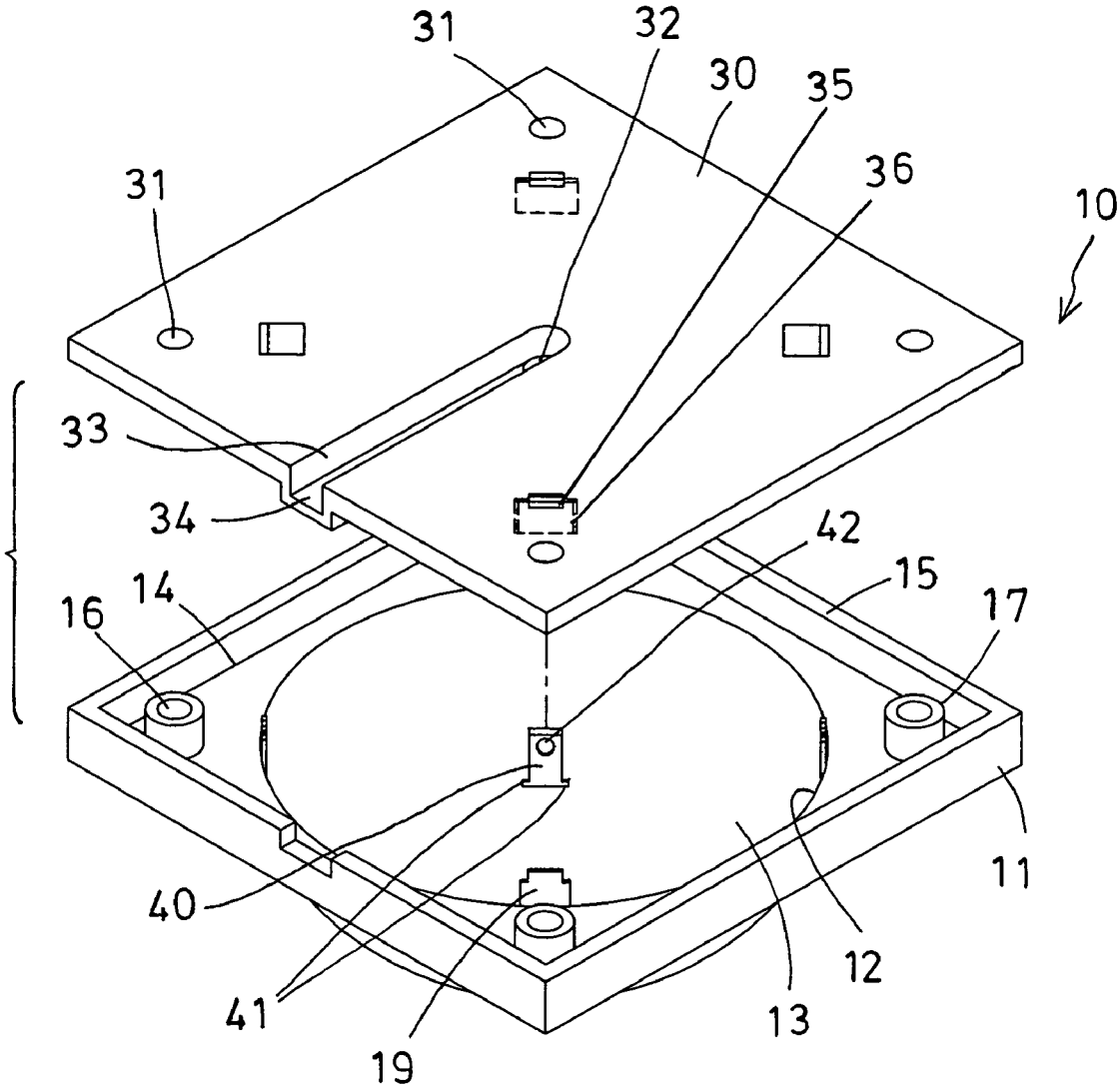
FIG. 3 is a partial exploded view similar to FIG. 1, illustrating the other embodiment of the ceiling antenna housing.
Figure 4:
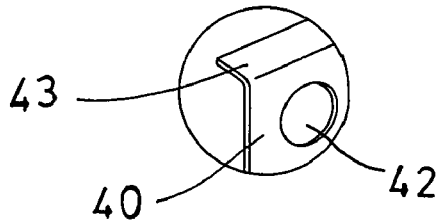
FIG. 4 is an enlarged partial perspective view of the ceiling antenna housing as shown in FIG. 3.
Figure 5:
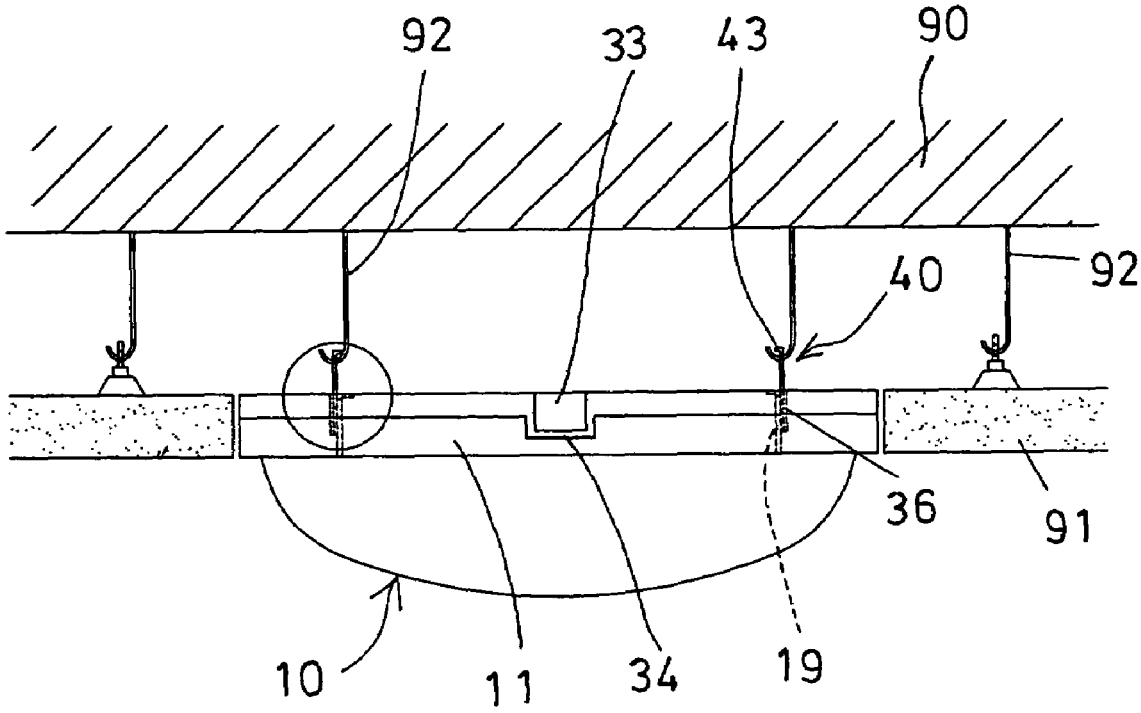
FIG. 5 is a plan schematic view of the ceiling antenna housing as shown in FIG. 3.
Figure 6:
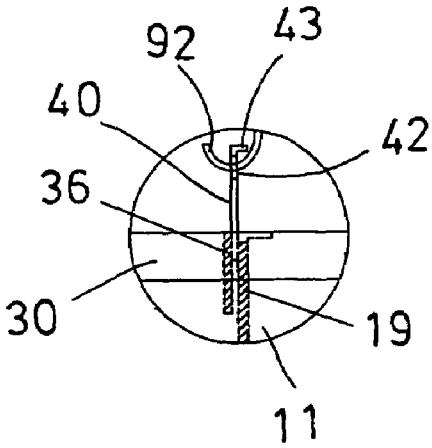
FIG. 6 is an enlarged partial plan schematic view of the ceiling antenna housing as shown in FIG. 5.
Figure 7:
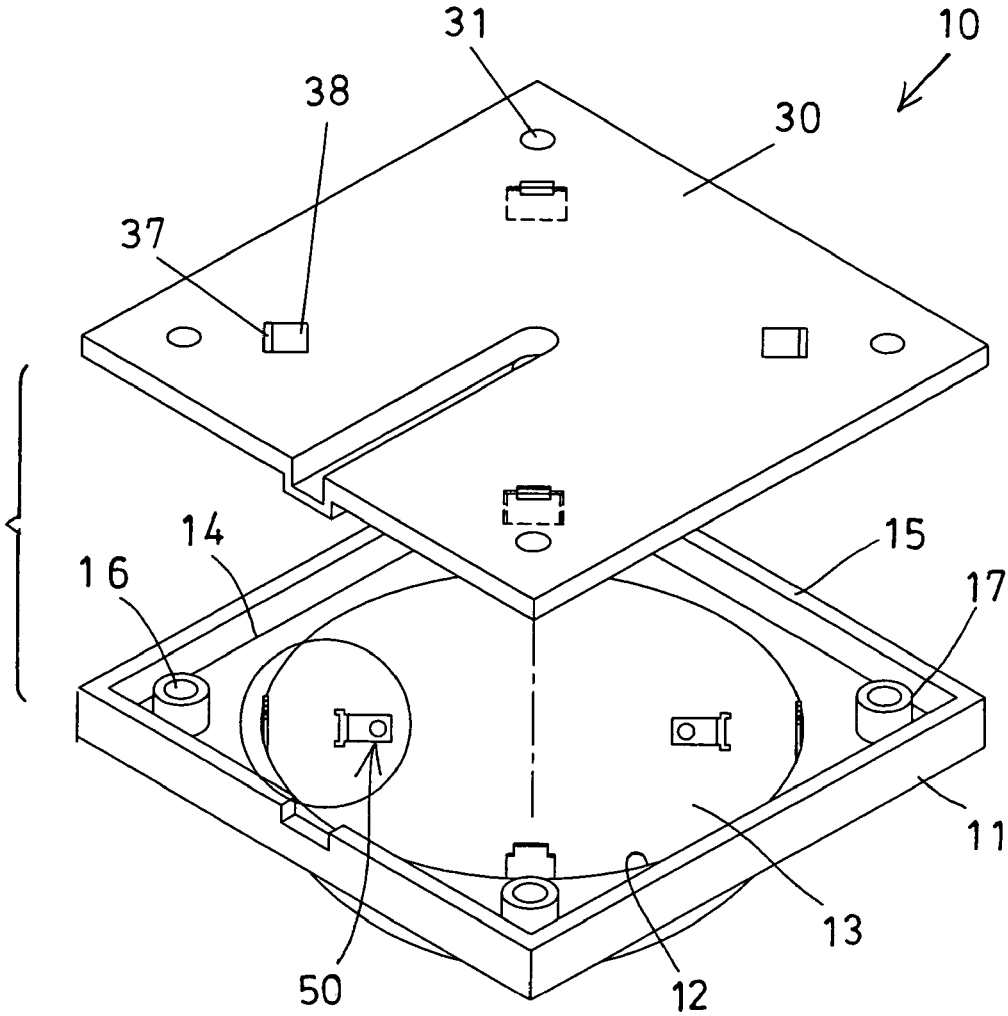
FIG. 7 is a partial exploded view similar to FIGS. 1 and 3, illustrating the further embodiment of the ceiling antenna housing.

Referring to the drawings, and initially to FIGS. 1 and 2, a ceiling antenna housing 10 in accordance with the present invention comprises a base or lower receptacle 11 including a chamber 12 formed therein for receiving an antenna member 13 therein, and including a recess 14 formed in the upper portion thereof and defined by an outer peripheral wall 15, and including a number of orifices 16 formed therein and defined by studs 17, for receiving fasteners 20 therein.

For example, the fasteners 20 each includes an enlarged head 21 formed or provided on one end or lower end thereof, for engaging with the lower receptacle 11 (FIG. 2), and for anchoring the fasteners 20 to the receptacle 11, and each includes an aperture 22 formed in the other end or upper end thereof for receiving or engaging with hanger members 92 that are typically used for hooking or attaching or securing the ceiling panels 91 to the ceiling 90.

The ceiling antenna housing 10 further includes a cover 30 attached or engaged onto the receptacle 11, such as engaged onto the outer peripheral wall 15 of the receptacle 11, and having a number of cavities 31 formed therein and aligned with the orifices 16 of the receptacle 11, for receiving fasteners 20 therein, and a number of lock nuts 23 may be threaded to the fasteners 20, for solidly and/or detachably locking or securing the cover 30 to the receptacle 11.

The cover 30 may further includes an opening 32 formed therein, and a channel or passage 33 formed therein and communicating with the opening 32 thereof, for receiving electric wires or cables (not shown) therein, and includes a casing 34 to form or to define the passage 33 thereof. The receptacle 11 includes a notch 18 formed therein, to receive the casing 34, and to further anchor or position the cover 30 to the receptacle 11.

In operation, as shown in FIG. 2, the apertures 22 of the fasteners 20 may be easily and readily engaged with the hanger members 92 that are typically used for hooking or attaching the ceiling panels 91 to the ceiling 90, for allowing the ceiling antenna housing 10 to be easily and readily attached to the ceiling 90 or the walls of the buildings without drilling holes into the ceiling 90 or the walls by the users themselves.

Referring next to FIGS. 3-6, illustrated is another embodiment of the ceiling antenna housing 10 which also includes a base or lower receptacle 11 including a chamber 12 formed therein for receiving an antenna member 13 therein, and including a recess 14 formed in the upper portion thereof and defined by an outer peripheral wall 15, and including a number of orifices 16 formed therein and defined by studs 17. A cover 30 may be attached onto the receptacle 11 and having a number of cavities 31 formed therein and aligned with the orifices 16 of the receptacle 11.

The cover 30 may further include one or more slots 35 formed therein, and one or more flaps 36 extended downwardly therefrom and located beside the slots 35 respectively. The receptacle 11 also includes one or more ears 19 extended upwardly therefrom and located beside the flaps 36 of the cover 30 respectively.

One or more hooking members 40 may further be provided and slidably engaged through the slots 35 of the cover 30, and may include one or more legs 41 laterally extended from one end or lower end thereof, for engaging with the cover 30, and for limiting the movement of the hooking members 40 relative to the cover 30, and for preventing the hooking members 40 from being disengaged from the cover 30. The hooking members 40 may also be slidably anchored or positioned between the flaps 36 of the cover 30 and the ears 19 of the receptacle 11 respectively.

The hooking members 40 each also includes an aperture 42 formed in the other end or upper end thereof for receiving or engaging with hanger members 92 (FIGS. 5, 6) that are typically used for hooking or attaching the ceiling panels 91 to the ceiling 90. It is preferable that the hooking members 40 each includes an bent flange 43 formed on the other end or upper end thereof for reinforcing purposes.

Referring next to FIGS. 7-10, illustrated is a further embodiment of the ceiling antenna housing 10 which also includes a base or lower receptacle 11 including a chamber 12 formed therein for receiving an antenna member 13 therein. A cover 30 may be attached onto the receptacle 11 and having a number of cavities 31 formed therein and suitably aligned with the orifices 16 of the receptacle 11. The cover 30 may further include one or more grooves 37 formed therein, and may further include one or more depressions 38 formed therein and communicating with the grooves 37 thereof respectively.

One or more anchoring members 50 may further be provided and slidably engaged through the grooves 37 of the cover 30, and may include one or more legs 51 extended from one end or lower end or bent end 52 thereof, for engaging with the cover 30, and for limiting the movement of the anchoring members 50 relative to the cover 30, and for preventing the anchoring members 50 from being disengaged from the cover 30.

The anchoring members 50 each also includes an aperture 53 formed in the other end or upper end thereof for receiving or engaging with hanger members 92 (FIGS. 9, 10) that are typically used for hooking or attaching the ceiling panels 91 to the ceiling 90. It is preferable that the anchoring members 50 each includes a notch 54 formed in the lower end or bent end 52 thereof. The anchoring members 50 is rotatable relative to the cover 30 and receivable in the depressions 38 of the cover 30 in the storing position, also shown in FIGS. 9 and 10.

Figure 8:
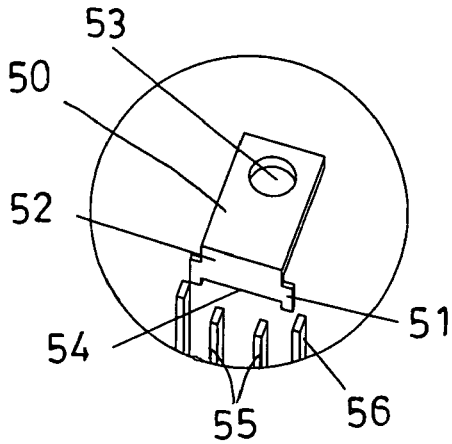
FIG. 8 is an enlarged partial perspective view of the ceiling antenna housing as shown in FIG. 7.
Figure 9:
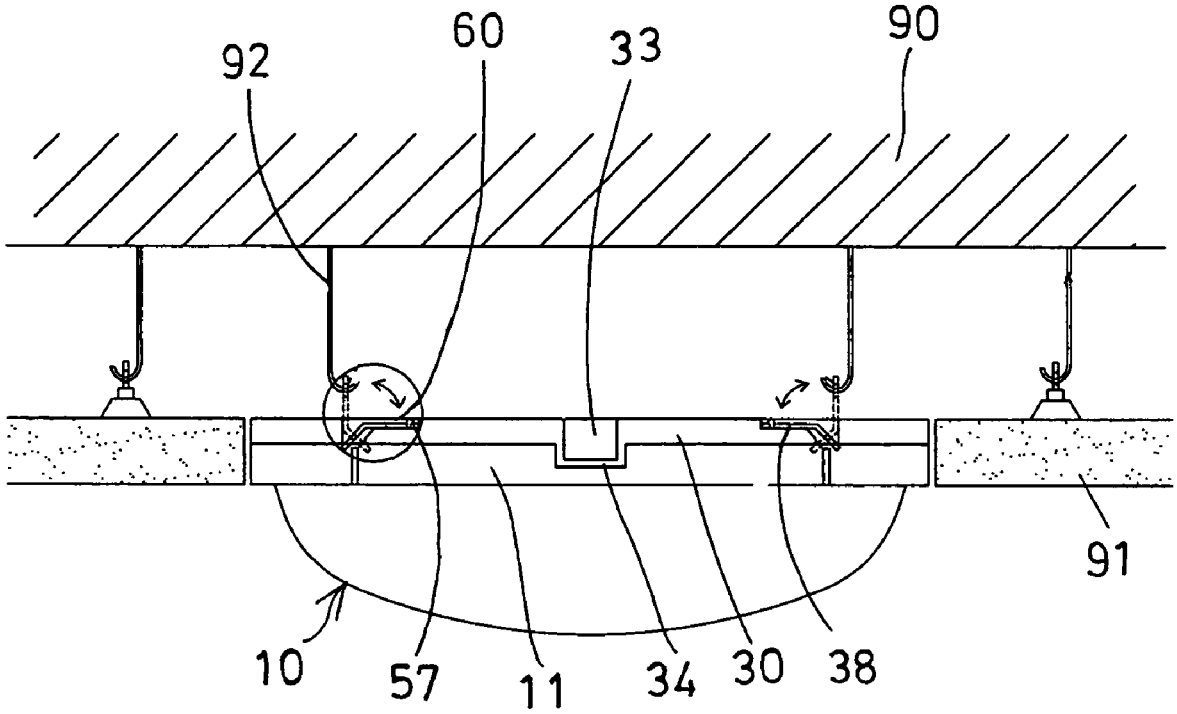
FIG. 9 is a plan schematic view of the ceiling antenna housing as shown in FIG. 7.
Figure 10:
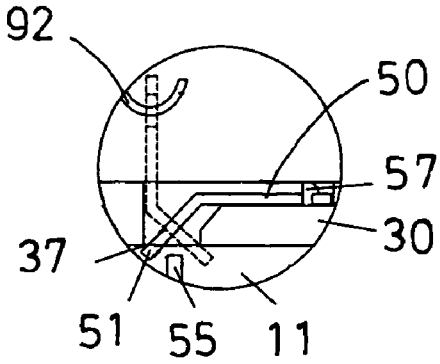
FIG. 10 is an enlarged partial plan schematic view of the ceiling antenna housing as shown in FIG. 9.

The receptacle 11 may include one or more projections 55 extended therefrom for engaging through the notch 54 of the anchoring members 50, and/or for engaging with the anchoring members 50, for supporting the anchoring members 50, and may include one or more protrusions 56 extended therefrom FIG. 8), for engaging with the legs 51 of the anchoring members 50, and for supporting or maintaining the anchoring members 50 at the upright or working position as shown in dotted lines in FIGS. 9 and 10. The receptacle 11 may further include a latch 57 extended therefrom for engaging through the aperture 53 of the anchoring members 50, and/or for engaging with the anchoring members 50, to anchor or position the anchoring members 50 in the depressions 38 of the cover 30.

Accordingly, the ceiling antenna housing in accordance with the present invention may be used for readily attaching to the ceiling of the buildings without drilling holes into the ceiling or the walls by the users themselves.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ceiling antenna housing comprising:

a receptacle including a chamber formed therein, an antenna member received in said chamber of said receptacle, a cover attached onto said receptacle and including at least one slot formed therein, and said cover including at least one flap extended downwardly therefrom and located beside said at least one slot thereof, a hooking member slidably engaged through said at least one slot of said cover and including at least one leg extended therefrom, for engaging with said cover and for limiting said hooking member to move relative to said cover and for preventing said hooking member from being disengaged from said cover, said hooking member including an aperture formed therein for engaging with hanger members, and said receptacle including at least one ear extended upwardly therefrom and located beside said at least one flap of said cover to slidably anchor said hooking member between said at least one flap of said cover and said at least one ear of said receptacle.

2. The ceiling antenna housing as claimed in claim 1, wherein said hooking member includes a bent flange formed on one end thereof.

3. A ceiling antenna housing comprising:

a receptacle including a chamber formed therein, and including at least one protrusion extended therefrom, an antenna member received in said chamber of said receptacle, a cover attached onto said receptacle and including at least one groove formed therein, and an anchoring member slidably engaged through said at least one groove of said cover and including at least one leg extended therefrom, for engaging with said cover and for limiting said anchoring member to move relative to said cover and for preventing said anchoring member from being disengaged from said cover, said anchoring member including an aperture formed therein for engaging with hanger members, and said at least one protrusion of said receptacle being provided for engaging with said at least one leg of said anchoring member and for maintaining said anchoring member to said cover.

4. The ceiling antenna housing as claimed in claim 3, wherein said cover includes a depression formed therein and communicating with said at least one groove thereof, for receiving said anchoring member.

5. The ceiling antenna housing as claimed in claim 3, wherein said cover includes a latch extended therefrom for engaging through said aperture of said anchoring members, to anchor said anchoring member to said cover.

* * * * *